US011028661B2

(12) United States Patent
Kegin

(10) Patent No.: US 11,028,661 B2
(45) Date of Patent: Jun. 8, 2021

(54) FISHING NECK FOR PLUNGER

(71) Applicant: Tri-Lift Services, Inc., Crescent, OK (US)

(72) Inventor: Kevin Kegin, Crescent, OK (US)

(73) Assignee: Tri-Lift Services, Inc., Crescent, OK (US)

( * ) Notice: Subject to any disclaimer, the term of this patent is extended or adjusted under 35 U.S.C. 154(b) by 113 days.

(21) Appl. No.: 16/548,168

(22) Filed: Aug. 22, 2019

(65) Prior Publication Data

US 2021/0054711 A1 Feb. 25, 2021

(51) Int. Cl.

| | |
|---|---|
| ***E21B 31/18*** | (2006.01) |
| ***E21B 31/20*** | (2006.01) |
| ***F04B 47/12*** | (2006.01) |
| *E21B 43/12* | (2006.01) |

(52) U.S. Cl.

CPC ..... *E21B 31/20* (2013.01); *E21B 31/18* (2013.01); *F04B 47/12* (2013.01); *E21B 43/121* (2013.01)

(58) Field of Classification Search

None

See application file for complete search history.

(56) References Cited

U.S. PATENT DOCUMENTS

| | | | | |
|---|---|---|---|---|
| 2,325,503 | A * | 7/1943 | Goble | E21B 27/00 166/107 |
| 2,706,406 | A * | 4/1955 | Vincent | G01F 1/10 73/152.31 |
| 3,677,346 | A * | 7/1972 | Tamplen | E21B 23/006 166/385 |
| 3,942,833 | A * | 3/1976 | Plunk | E21B 23/00 294/86.18 |
| 4,648,445 | A * | 3/1987 | Caskey | E21B 31/18 166/98 |
| 4,898,245 | A * | 2/1990 | Braddick | E21B 23/06 166/123 |
| 2005/0115708 | A1* | 6/2005 | Jabusch | E21B 47/13 166/250.15 |
| 2007/0151738 | A1* | 7/2007 | Giacomino | E21B 34/14 166/372 |
| 2019/0277118 | A1* | 9/2019 | Boyd | F04B 47/12 |

* cited by examiner

*Primary Examiner* — Kipp C Wallace
(74) *Attorney, Agent, or Firm* — Dunlap Codding, P.C.

(57) ABSTRACT

A fishing neck for a plunger comprises a head portion, a neck portion, a lower portion, and a plurality of ribs. The head portion has a cylindrical configuration with an outer peripheral surface and an outer diameter. The neck portion also has a cylindrical configuration with an outer peripheral surface and an outer diameter, but the outer diameter is less than the outer diameter of the head portion. The neck portion extends from the head portion. The lower portion extends from the neck portion, which is opposite the head portion, and is connectable to a plunger. The lower portion has an outer diameter greater than the outer diameter of the neck portion. A plurality of ribs projects from the outer peripheral surface of the neck portion and extends helically from the head portion to the lower portion.

20 Claims, 4 Drawing Sheets

FISHING NECK FOR PLUNGER

BACKGROUND

Plunger lift systems are used in oil and gas wells when the bottom hole pressure decreases to a point it cannot effectively lift fluids to the surface. A plunger, which is a piston-like object, is placed inside the production tubing. Through use of the s pressure of the well, plungers move up the tubing to lift the fluids to the surface. A valve at the surface when closed causes the pressure to build so that when opened, the plunger rises to the top carrying the fluids to the surface. The plunger returns to the bottom when the valve is closed. The return velocity may be increased using a bypass plunger, where a valve inside the plunger is opened allowing fluid to flow through the center of the plunger.

Because plungers are not attached to surface equipment, they are generally provided with a fishing neck to facilitate retrieval should the plunger become stuck in the well. The fishing neck provides an area on which fishing tools can latch. Fishing tools often include an arrangement of collets that can pass over an upper portion of a tool and then spring inwardly to grasp the tool. Some fishing necks are hollow to accommodate a shock absorber for absorbing impact forces to a shift rod of the plunger. Most fishing necks maximize the area that may receive the jaws of the fishing tool. This has led to fishing necks being designed with a thin wall section extending around the circumference of the fishing neck.

In a plunger system, a bumper is provided at the top and bottom of the wellbore to absorb energy of the plunger as it travels up and down the tubing. Nevertheless, the repeated contact of the fishing neck with the top bumper can cause the thin walled area of the fishing neck to fatigue and fail.

A need exists for an improved fishing neck with a strengthened sidewall, but which still provides quick and easy access to retrieve the plunger using conventional fishing tools. It is to such an apparatus that the inventive concepts disclosed herein are directed.

DETAILED DESCRIPTION OF EXEMPLARY EMBODIMENTS

Figure 1:
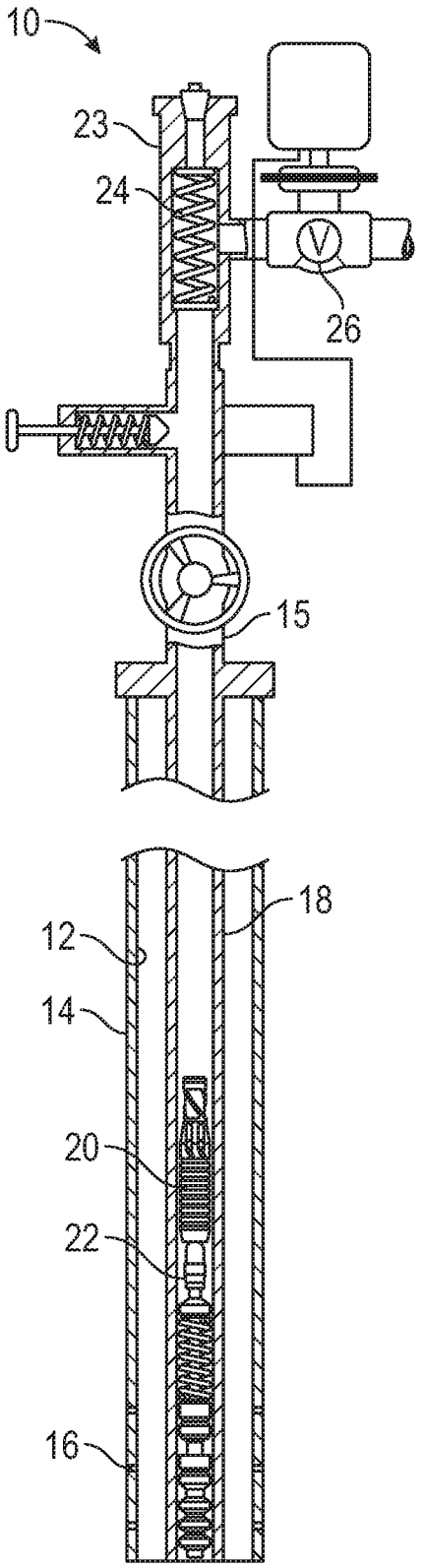
FIG. 1 is a sectional view of a plunger lift system for removing fluid from a well bore illustrating a plunger at the bottom of the well bore.

The inventive concepts disclosed are generally directed to a fishing neck for a plunger that includes a head portion, a neck portion, a lower portion, and a plurality of ribs. The head portion has a cylindrical configuration with an outer peripheral surface and an outer diameter. The neck portion has a cylindrical formation with an outer peripheral surface and an outer diameter, which is less than the outer diameter of the head portion. The neck portion extends from the head portion. The lower portion extends from the neck portion and is opposite the head portion. The lower portion has an outer diameter greater than the outer diameter of the neck portion and is connectable to a plunger. The plurality of ribs project from the outer peripheral surface of the neck portion and extend helically from the head portion to the lower portion.

In another version, the inventive concepts disclosed are directed to a fishing neck in combination with a plunger which has an upper end and a lower end. The fishing neck has a head portion, a neck portion, and lower portion, and a plurality of ribs. The head portion has a cylindrical configuration with an outer peripheral surface and an outer diameter. The neck portion has a cylindrical configuration with an outer peripheral surface and an outer diameter less than the outer diameter of the head portion. The neck portion extends from the head portion. The lower portion extends from the neck portion and is opposite the head portion. The lower potion has an outer diameter greater than the outer diameter of the neck portion. The lower portion is connected to a plunger. A plurality of ribs project from the outer peripheral surface of the neck portion and extend helically from the head portion to the lower portion.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
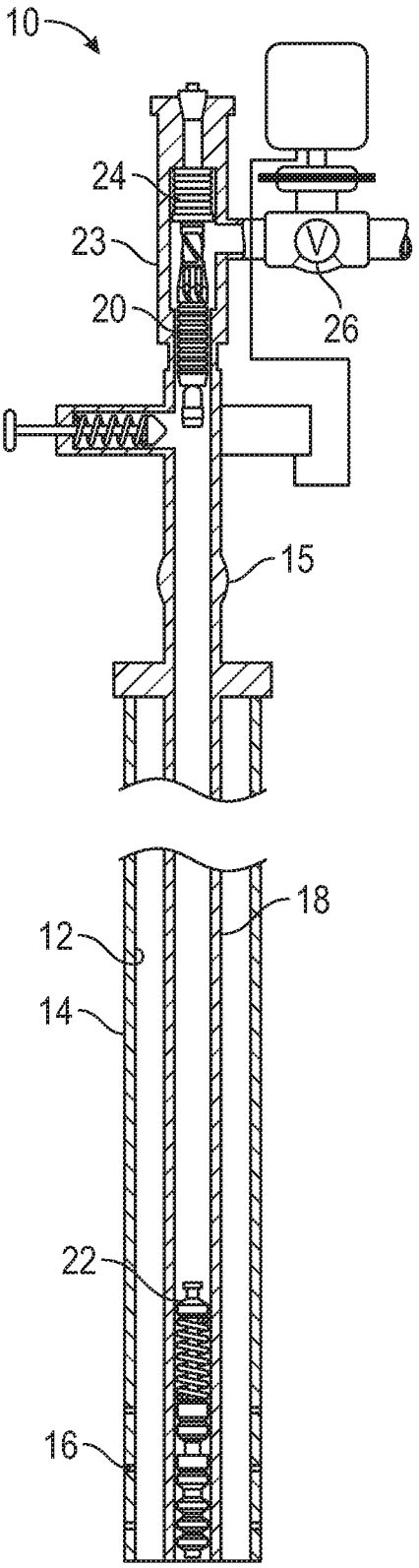
FIG. 2 is a sectional view of the plunger lift system of FIG. 1 illustrating the plunger at the top of the well bore.

Referring now to the drawings, and in particular to FIGS. 1 and 2, a plunger lift system 10 for removing fluid, such as oil and water, from a well bore 12 is schematically illustrated. The well bore 12 is shown to be lined with a casing 14 extending downwardly from a wellhead 15. The casing 14 provides a permanent borehole through which production operations may be conducted. The casing 14 is affixed in the well bore 12 in a conventional manner, such as by cement (not shown), and is provided with perforations 16 open to a producing subterranean formation (also not shown).

The plunger lift system 10 includes a tubing string 18, a plunger 20, a bottom bumper 22, a lubricator 23 with a top bumper 24, and a control valve 26. The tubing string 18 provides fluid communication between the producing subterranean formation and the surface such that a reservoir fluid (not shown), for example water and/or oil and/or natural gas, is produced through the tubing string 18. The casing 14 and the tubing string 18 define an annulus 19, which also provides fluid communication through the well bore 12.

The plunger 20 is illustrated as being a sliding sleeve plunger. However, it will be appreciated that the inventive concepts disclosed herein are also applicable to other types of plungers. The plunger 20 is dropped into the tubing string 18. When the control valve 26 is closed, pressure is allowed to build so when the control valve 26 is opened, the plunger 20 rises to the top carrying the fluids to the surface. The plunger 20 returns to the bottom when the control valve 26 is closed. Through operation of the control valve 26, a liquid slug is cyclically brought to the surface of the wellbore 12 from stored gas pressure. In the off cycle, the plunger 20 falls and pressure builds again in the wellbore 12.

As described above, plungers are free pistons unattached to surface equipment. As such, they are generally provided with a fishing neck to facilitate retrieval should the plunger become stuck in the wellbore. The fishing neck provides an area on which fishing tools can latch. Fishing tools often include an arrangement of collets that can pass over an upper portion of a tool and then spring inwardly to grasp the tool. Most fishing necks maximize the area that may receive the jaws of the fishing tool. This has led to fishing necks being designed with a thin wall section extending around the circumference of the fishing neck. The repeated contact of the fishing neck with the upper bumper spring can cause the thin walled area of the fishing neck to fatigue and fail.

Figure 3:
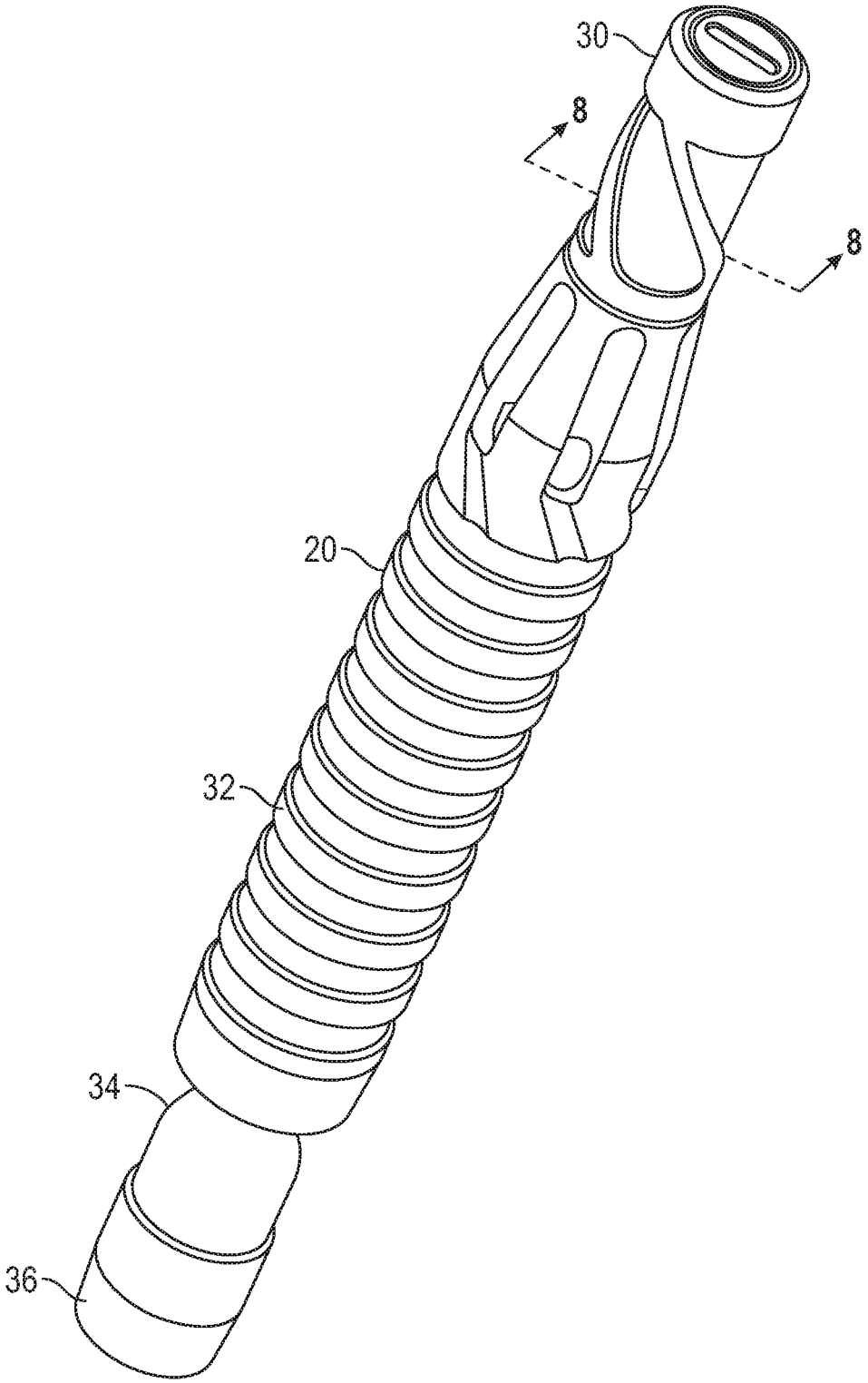
FIG. 3 is a perspective view of the plunger with a fishing neck constructed in accordance with the inventive concepts disclosed herein connected thereto.
Figure 8:
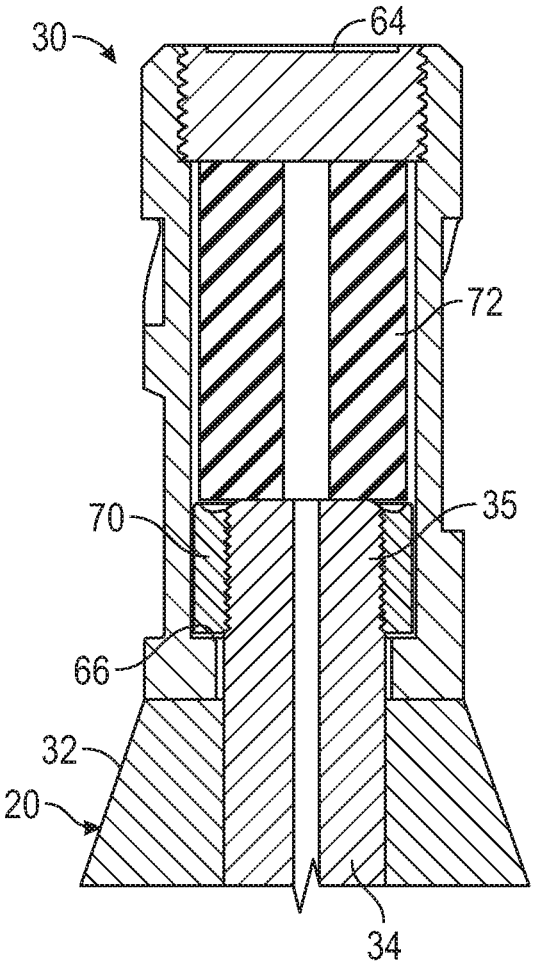
FIG. 8 is a sectional view taken along line 8-8 of FIG. 3 illustrating the fishing neck connected to the plunger.

Referring now to FIGS. 3 and 8, a fishing neck 30 constructed in accordance with the inventive concepts disclosed herein is shown connected to the plunger 20. In one embodiment, the plunger 20 has a sleeve 32 and a rod 34. The sleeve 32 may be ribbed. The rod 34 has an upper end 35 (FIG. 8) and a lower end 36. The rod 34 is slidable relative to the sleeve 32 between a down position (FIGS. 3 and 8) and an up position (not shown). In the down position, a flow path through the sleeve 32 is open allowing fluid to flow through the sleeve 32 as the plunger 30 is returning to the bottom of the wellbore 12. In the up position, the lower end 36 of the rod 34 closes the flow path allowing the plunger 30 to lift fluid to the surface as the plunger 30 is rising to the top of the wellbore 12.

In a manner to be discussed below with reference to FIG. 8, the fishing neck 30 is connected to the upper end 35 of the rod 34. The rod 34 is moved between the down position and the up position by engagement with the bottom bumper 22 and the top bumper 24. Contact of the lower end 36 of the rod 34 with the bottom bumper 22 causes the rod 34 to move from the down position to the up position. Contact of the fishing neck 30 with the top bumper 24 causes the rod 34 to move from the up position to the down position.

Referring to FIGS. 4-8, the fishing neck 30 includes a head portion 40, a neck portion 42, and a lower portion 44. The head portion 40 has a cylindrical configuration with an outer peripheral surface 46 and an outer diameter. An upper edge 47 of the head portion 40 may be beveled. The neck portion 42 extends from the head portion 40 and has a cylindrical configuration with an outer peripheral surface 48 and an outer diameter, which is less than the outer diameter of the head portion 40 to form a shoulder 48. The lower portion 44 extends from the neck portion 42 and has an outer diameter greater than the outer diameter of the neck portion 42. As will be described below, the lower portion 44 is connectable to the plunger 20.

Figure 7:
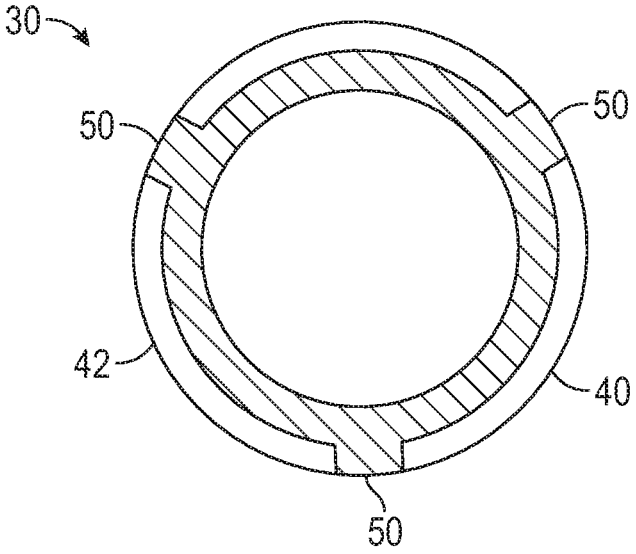
FIG. 7 is a sectional view taken along line 7-7 of FIG. 5.

The fishing neck 30 has a plurality of ribs 50 projecting from the outer peripheral surface 49 of the neck portion 42. The ribs 50 are spaced apart and extend helically from the head portion 40 to the lower portion 44 so as to form slots 52 between the ribs 50. Each of the ribs 50 is coextensive with a portion of the outer peripheral surface 46 of the head portion 40 so the ribs 50 are at least flush with the outer peripheral surface 46 of the head portion 40. The ribs 50 may also be coextensive with a portion of an outer peripheral surface 54 of the lower portion 44. In one embodiment, the fishing neck 30 has three ribs 50 equally spaced circumferentially about the neck portion 16 (FIG. 7). It will be appreciated that the number of ribs is not limited to three, but may be varied.

The ribs 50 are spaced and angled such that collets (not shown) of a fishing tool may be received between the ribs 50. The helical configuration of the ribs 50 allows the collets to slide longitudinally down the fishing neck 30 with assurance that the collets will slide off the ribs 50 and into the slots 52 formed by the ribs 50 without requiring the collets to be rotated. In one embodiment, an upper end of the ribs 50 is longitudinally aligned with a lower end of an adjacent rib 50. The ribs 50 may be fabricated to have a depth of about 0.175 inches and a width of about 0.25 inches. The ribs 50 may be rotated so where one rib 50 extends from the head portion 40, an adjacent rib 50 extends from the lower portion 44 in longitudinal alignment. By way of example, when the fishing neck 30 includes three ribs 50, the ribs are equally spaced and each of the ribs 50 may be rotated 120 degrees.

Figure 4:
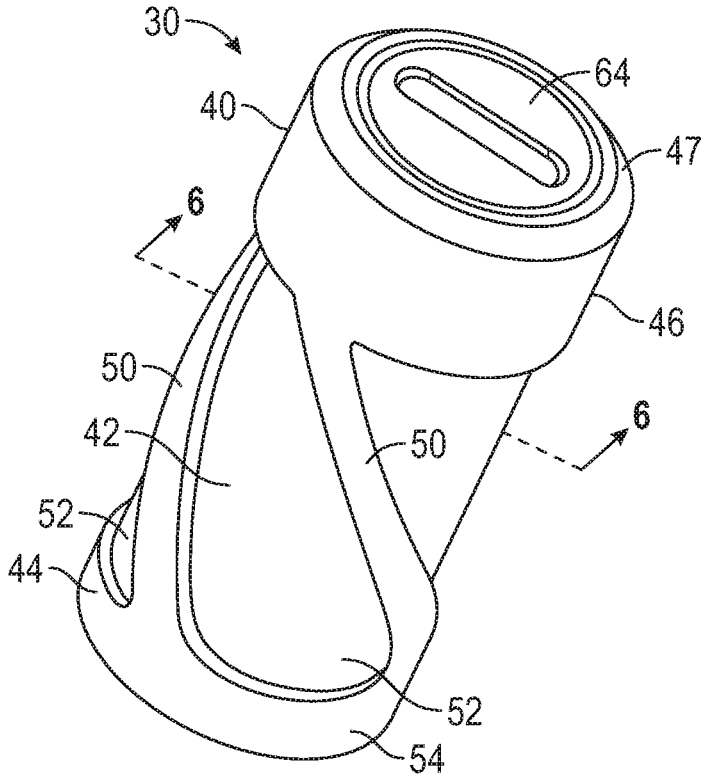
FIG. 4 is a perspective view of the fishing neck.
Figure 5:
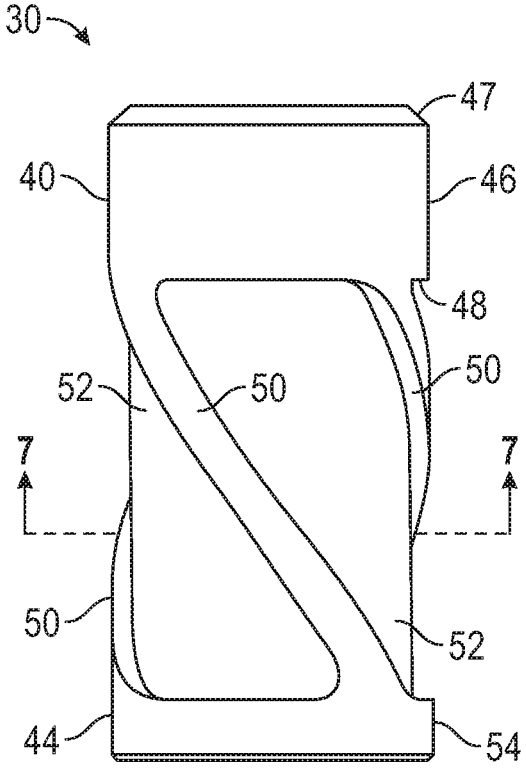
FIG. 5 is an elevational view of the fishing neck of FIG. 4.
Figure 6:
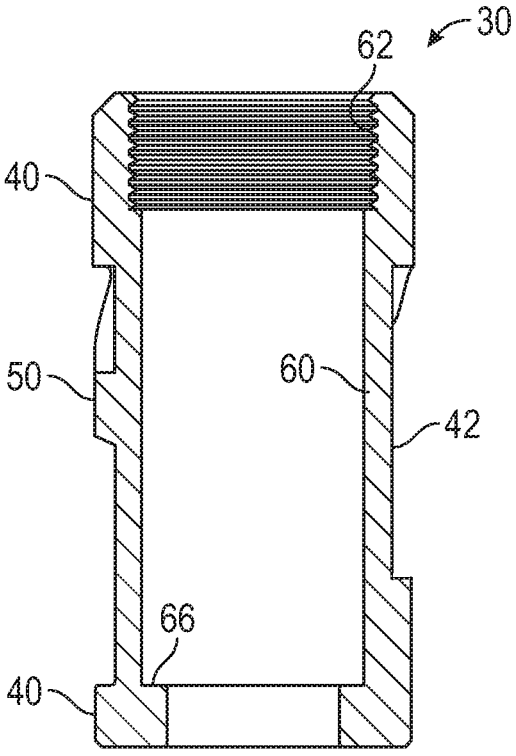
FIG. 6 is a sectional view taken along line 6-6 of FIG. 4 with a plug removed.

As shown in FIG. 6, the fishing neck 30 may have a bore 60 extending through the head portion 40, the neck portion 42, and the lower portion 44. The bore 60 has a threaded portion 62 in the head portion 40 for receiving a plug 64 (FIGS. 4 and 8). The bore 60 has an internal shoulder 66 at the lower portion 44.

FIG. 8 is a sectional view illustrating the fishing neck 30 connected to the plunger 20. The upper end 35 of the rod 34 of the plunger 20 is inserted into the bore 60. In one embodiment, a fastener 70, such as a nut, may be threadingly connected to the upper end 35 of the rod 34 so the fastener 70 is engagable with the interior shoulder 66 of the lower portion 44. The fastener 70 may be welded or otherwise permanently affixed to the rod 34.

A shock absorber 72 is positioned adjacent to the upper end 35 of the rod 34. The shock absorber 72 may be tubular or cylindrical member fabricated of an elastomeric material, such as rubber. The shock absorber 72 is secured in the bore 60 with the plug 64 so the shock absorber 72 is interposed between the plug 64 and the upper end 35 of the rod 34. The shock absorber 72 absorbs the impact force to the rod 34 upon impact of the fishing neck 30 with the top bumper 24.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and as defined in the appended claims.

What is claimed is:

1. A fishing neck for a plunger, comprising:

a head portion having a cylindrical configuration with an outer peripheral surface and an outer diameter;

a neck portion having a cylindrical configuration with an outer peripheral surface and an outer diameter less than the outer diameter of the head portion, the neck portion extending from the head portion;

a lower portion extending from the neck portion opposite the head portion, the lower portion connectable to a plunger and having an outer diameter greater than the outer diameter of the neck portion; and a plurality of ribs projecting from the outer peripheral surface of the neck portion and extending helically from the head portion to the lower portion.

2. The fishing neck of claim 1, wherein the ribs are equally spaced circumferentially about the neck portion.

3. The fishing neck of claim 1, wherein each of the ribs is coextensive with a portion of the outer peripheral surface of the head portion.

4. The fishing neck of claim 3, wherein the ribs are equally spaced circumferentially about the neck portion.

5. The fishing neck of claim 4, wherein the plurality of ribs is at least three ribs.

6. The fishing neck of claim 1, wherein the lower portion has a cylindrical configuration with an outer peripheral surface, and wherein each of the ribs is coextensive with a portion of the outer peripheral surface of the head portion and a portion of the outer peripheral surface of the lower portion.

7. The fishing neck of claim 5, wherein the ribs are equally spaced circumferentially about the neck portion.

8. The fishing neck of claim 7, wherein the plurality of ribs is at least three ribs.

9. The fishing neck of claim 1, wherein each of the head portion, the neck portion, and lower portion has a bore extending therethrough.

10. The fishing neck of claim 9, where the bore of the head portion is threaded, and wherein the fishing neck further comprises a plug positioned in the bore of the head portion and threadingly connected thereto.

11. The fishing neck of claim 1, wherein an upper edge of the head portion is beveled.

12. A fishing neck in combination with a plunger, the plunger have an upper end and a lower end, the fishing neck comprising:

a head portion having a cylindrical configuration with an outer peripheral surface and an outer diameter;

a neck portion having a cylindrical configuration with an outer peripheral surface and an outer diameter less than the outer diameter of the head portion, the neck portion extending from the head portion;

a lower portion extending from the neck portion opposite the head portion, the lower portion connected to the upper end of the plunger and having an outer diameter greater than the outer diameter of the neck portion; and a plurality of ribs projecting from the outer peripheral surface of the neck portion and extending helically from the head portion to the lower portion.

13. The combination of claim 12, wherein the ribs are equally spaced circumferentially about the neck portion.

14. The combination of claim 12, wherein each of the ribs is coextensive with a portion of the outer peripheral surface of the head portion.

15. The combination of claim 14, wherein the ribs are equally spaced circumferentially about the neck portion.

16. The combination of claim 15, wherein the plurality of ribs is at least three ribs.

17. The combination of claim 12, wherein the lower portion has a cylindrical configuration with an outer peripheral surface, and wherein each of the ribs is coextensive with a portion of the outer peripheral surface of the head portion and a portion of the outer peripheral surface of the lower portion.

18. The combination of claim 17, wherein the ribs are equally spaced circumferentially about the neck portion.

19. The combination of claim 18, wherein the plurality of ribs is at least three ribs.

20. The combination of claim 12, wherein each of the head portion, the neck portion, and lower portion has a bore extending therethrough.

* * * * *